US005250326A

United States Patent [19]

Drummond et al.

[11] Patent Number: 5,250,326

[45] Date of Patent: Oct. 5, 1993

[54] REDUCTION OF NONMETALLIC COATING SURFACE VERTICAL IRREGULARITIES BY ELECTROSTATIC PRESSURE

[75] Inventors: James E. Drummond, Oceanside; David B. Chang, Tustin, both of Calif.; Alexander H. Joyce, Livonia, Mich.

[73] Assignee: Hughes Aircraft Company, Los Angeles, Calif.

[21] Appl. No.: 814,206

[22] Filed: Dec. 20, 1991

Related U.S. Application Data

[63] Continuation of Ser. No. 544,575, Jun. 27, 1990, abandoned.

[51] Int. Cl.[5] ..... B05D 1/04

[52] U.S. Cl. ..... 427/466; 427/287; 427/331; 427/458; 427/473; 427/533

[58] Field of Search ..... 427/43.1, 14.1, 466, 427/287, 331, 458, 473, 533

[56] References Cited

U.S. PATENT DOCUMENTS 4,911,947 3/1990 Melcher ..... 427/26

*Primary Examiner*—Bernard Pianalto

*Attorney, Agent, or Firm*—Elizabeth E. Leitereg; Terje Gudmestad; W. K. Denson-Low

[57] ABSTRACT

A time-efficient method for smoothing a surface 20 of an applied coating composition 22 is disclosed herein. In particular, the present invention sets forth a technique for expediting the subsidence of coating surface nonmetallic vertical irregularities R1, R2. The technique of the present invention is applied subsequent to the application of the coating composition 22 to an electrically conductive object 24, which results in the formation of a coating surface 20. The technique of the present invention includes the step of generating electrically charged particles 40 in a volume of space adjacent to the coating surface 20. The charged particles 40 cause an electric field to develop across the coating composition 22, which induces the charged particles 40 to exert pressure on the coating surface 20.

17 Claims, 2 Drawing Sheets

FIG. 1
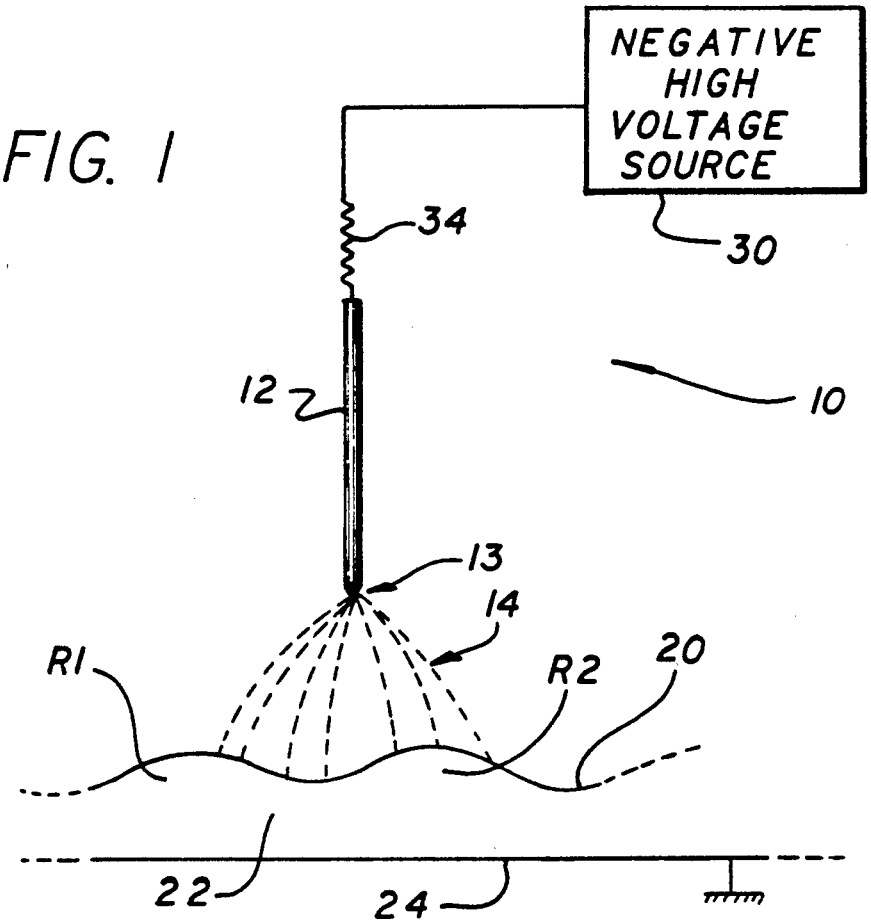
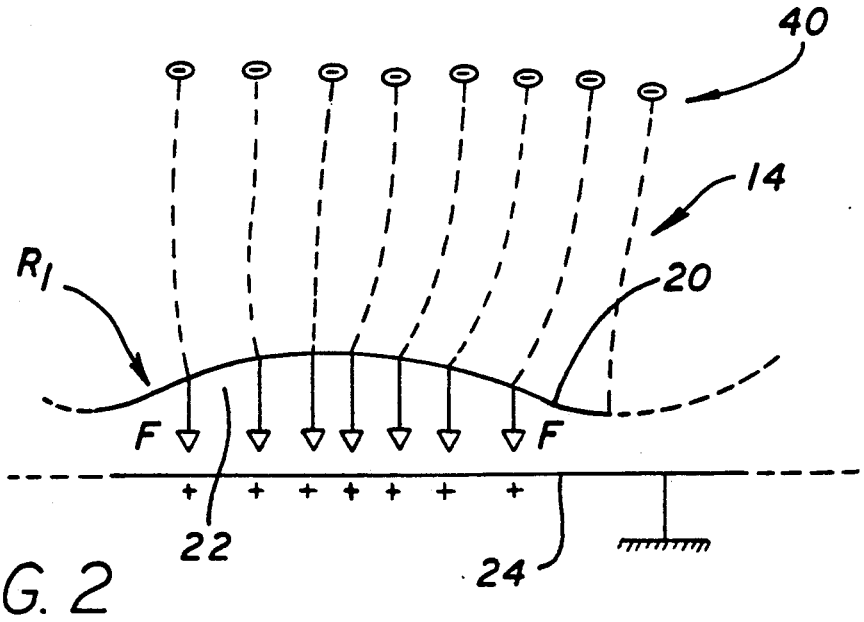
FIG. 2

REDUCTION OF NONMETALLIC COATING SURFACE VERTICAL IRREGULARITIES BY ELECTROSTATIC PRESSURE

This is a continuation of application Ser. No. 07/544,575 filed Jun. 27, 1990, abandoned.

BACKGROUND OF THE INVENTION

Field of the Invention

The present invention relates to methods of applying coating compositions. More specifically, the present invention relates to techniques for enhancing the surface uniformity of an applied nonmetallic coating.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Description of the Related Art

The external appearance of a finished vehicle depends in large part on the quality of the coating of paint applied thereto. In particular, certain irregularities in the painted surface of an automobile reflect light in such a manner as to exhibit an "orange peel" texture upon close examination.

Automobile manufacturers have heretofore relied on the surface tension of the applied paint coating to relax the ripples creating such an orange peel texture. Although relying exclusively on surface tension to reduce paint surface irregularity is time consuming, early painting processes were of sufficient duration to allow this technique to be of some utility. However, advances in automated automobile production have substantially reduced the time accorded the painting process. As surface tension relaxation of orange peel ripples typically consumes on the order of twenty hours, use of this technique has become impractical in automated systems.

Automobile manufacturers have also attempted to diminish the "orange peel" effect by adding organic material to the paint prior to application. The organic additives are utilized to reduce the viscosity of the paint. As a result of this lowered paint viscosity, ripples in the surface of paint coatings supplemented by organic additives subside more readily due to surface tension than do ripples subsisting on the surface of higher viscosity coatings.

Unfortunately, the organic additives commonly employed to lower paint viscosity are relatively volatile. This volatility results in the dissemination of the additives into the atmosphere during application. As the additives contribute to pollution, the additives have become subject to governmental restriction. Moreover, such low-viscosity paints tend to "slump" when applied to vertical surfaces due to the force of gravity.

Hence, a need exists in the art for a time-efficient method for smoothing the surface of an applied coating composition without resorting to the use of organic additives.

SUMMARY OF THE INVENTION

The need in the art for a time-efficient method for smoothing the surface of an applied coating composition is addressed by the technique of the present invention which involves the generation of electrically charged particles in a volume of space adjacent to the coating surface. The charged particles cause an electric field to develop across the viscous coating composition, which induces the charged particles to exert pressure on the coating surface. Hence, the technique of the present invention, employed subsequent to the application of a coating composition to an electrically conductive object, expedites the subsidence of coating surface irregularities.

BRIEF DESCRIPTION OF THE DRAWINGS

FIG. 1 is a diagram of a simplified, illustrative embodiment of an apparatus utilized to effect the ripple reduction technique of the present invention.

FIG. 2 is a magnified cross-sectional view of the coating composition and automobile surface.

DESCRIPTION OF THE INVENTION

Figure 3:
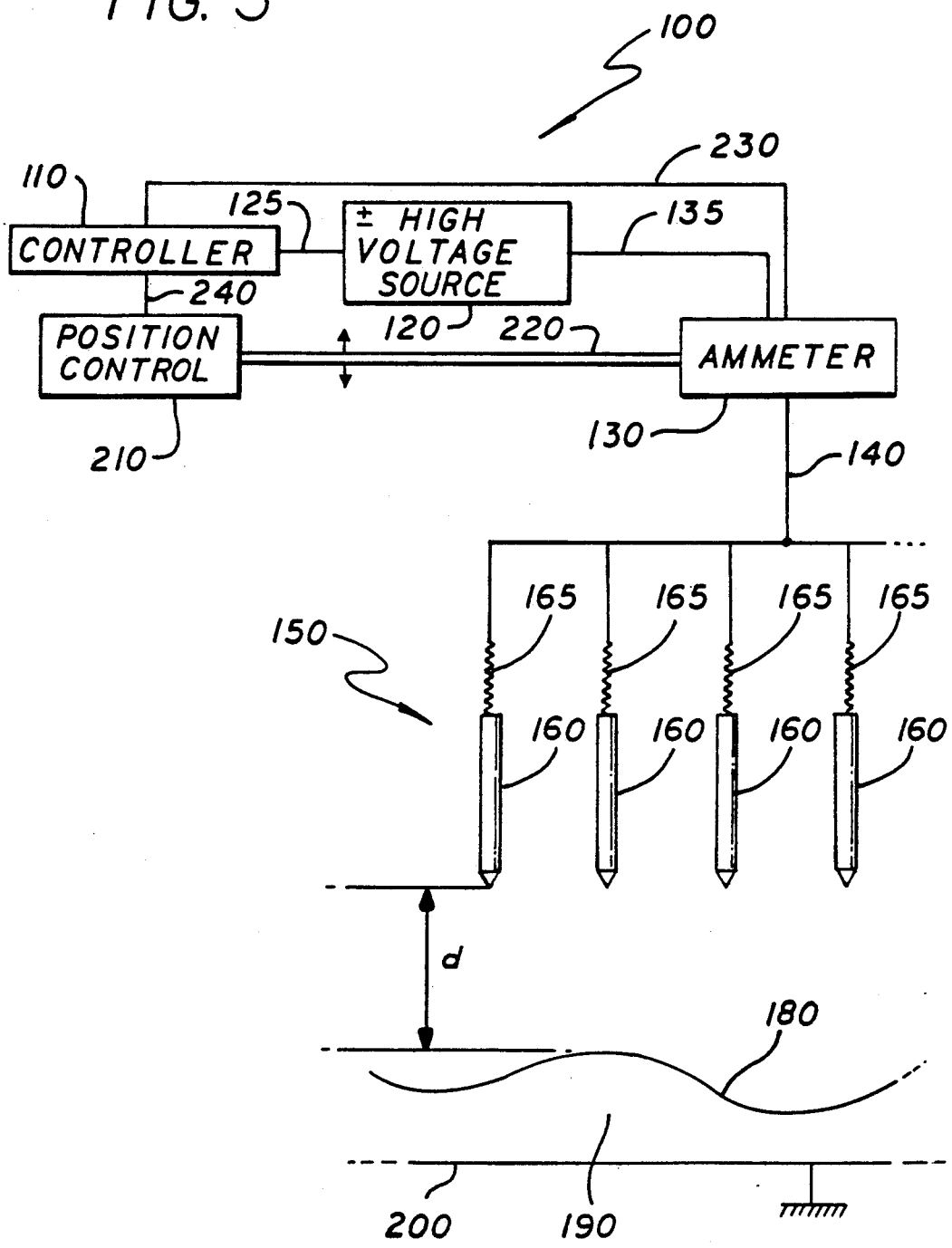
FIG. 3 is a diagram of an illustrative representation of a preferred embodiment of the ripple reduction apparatus of the present invention.

FIG. 1 is a simplified, illustrative embodiment of an apparatus 10 utilized to effect the coating surface irregularity reduction technique of the present invention. As will be described more fully below, the apparatus 10 includes a conductive needle 12 which induces an ionic discharge in the atmosphere surrounding the point 13 thereof. The charged ionic particles created by the discharge subsequently follow electric field lines 14 to reach a surface 20 of a nonmetallic coating composition 22. The charged particles expedite the subsidence of vertical irregularities on the surface 20, such as the ripples R1 and R2, by exerting electrostatic pressure thereon.

Prior to precipitation of the ionic discharge the coating 22 is applied by conventional means to a grounded, electrically conductive automobile surface 24. In the embodiment of FIG. 1 the coating 22 is clear (contains no pigment), and covers a previously applied pigmented base coat (not shown). As shown in FIG. 1, the coating 22 has not yet solidified following application to the automobile surface 24, and resides thereon in a viscous liquid state.

The apparatus 10 includes a negative high voltage source 30. In the preferred embodiment, the voltage source is capable of providing up to $-100$ kV. An isolating resistor 34 is electrically coupled to the source 30 and serves to constrain the amount of current flowing to the needle 12. In the preferred embodiment, the resistor 34 is chosen to have a value on the order of $10^6$ ohms to achieve the desired current level. The needle 12 may be realized from an electrical conductor, such as tungsten, having a sharpened point 13. The radius of curvature of the needle point 13 is chosen in conjunction with the value of the voltage source 30 such that the electric field produced by the needle 12 is sufficient to ionize the atmosphere.

The parabolic relation between corona current and voltage is expressed by:

$$i = A\nu(v - M) \qquad [1]$$

where i is the current, v is the voltage and A and M are experimentally determined constants.

An empirical relation developed by J. W. Peck and published in "Dielectric Phenomena in High Voltage Engineering" McGraw-Hill (1929) is useful for expressing the maximum surface stress for the onset of corona in air for several geometries of radius r cm. For spheres $$E=27.2\delta(1+0.54/(\delta r)^{\frac{1}{2}}) \quad [2]$$

where $\delta$ is the density of air relative to that at 25° C. and 1 atmosphere. For a point-plane electrode system, the relation between field strength E and voltage v is $E=v/d$. Thus, the field strength which initiated corona (at the negative sphere) given by Equation [2] can be used to find M in equation [1]:

$$M=27.2r\delta(1+0.54/(\delta r)^{\frac{1}{2}}) \quad [3]$$

To determine the practical limits down to which the radii of points can be taken, consider that it has been shown that a very small crystal of ten whiskers ($10^{-4}$ cm in diameter) can tolerate extremely large strains in bending without plastic deformation. Thus, radii of curvature down to $10^{-4}$ cm can be used in equation [3] which then gives, for atmospheric density in air, $M=0.15$ kv. An upper limit is set by the practical need for a large working voltage range between the onset of corona and the onset of spark breakdown which cooks and hardens the paint in isolated spots ruining the finish. The available working voltage range decreases rapidly from well over 100 kv at small radii to zero at a few cm radius. A large voltage range is needed in order to control the current which increases rapidly with voltage. A practical choice for the illustrative embodiment was $r \approx 0.1$ cm. at which $M=7.4$ kv.

FIG. 2 is a magnified cross-sectional view of the coating composition 22 and an automobile surface 24 at ripple R1. As shown in FIG. 2, negative ions 40 are created by ionization of the atmosphere surrounding the needle 12 (not shown). As a result of the presence of the negative ions 40, a positive charge (+) accumulates on the conductive surface of the automobile 24. Hence, an electric field, denoted by the electric field lines 14, is set up between the ions 40 and the automobile surface 24. The ions 40 follow the field lines 14 to the surface 20 of the coating 22, at which point the ions 40 exert a force F upon the surface 20. The force F acts in conjunction with the inherent tension of the surface 20 to expedite the subsidence of the ripple R1, thereby enhancing the uniformity of the surface 20.

In practice, the coating composition 22 typically has a breakdown field strength in excess of $10^5$ V/cm, and a dielectric permittivity of three. At this field strength, the electrostatic pressure exerted on the surface 20 due to the ions 40 is approximately $1.3\times10^4$ dynes/cm$^2$. In contrast, given that ripple R1 has a height of 10 $\mu$m, width of 0.5 cm, and surface tension of 30 dyne/cm (typical parameters for an "orange peel" ripple) the pressure exerted on the surface 20 due to inherent surface tension is only approximately 1 dyne/cm$^2$. The present invention is therefore operative to expedite the subsidence of coating surface ripples by increasing the pressure exerted thereon.

The following expression may be utilized to estimate the time (T) required for subsidence of a coating surface ripple:

where $\lambda$ is the period of surface ripples, N is the coating viscosity, E is the electric field strength at the coating surface, r is the dielectric permittivity and X is the coating thickness. Using the parameters of $\lambda=0.5$ cm, $N=1$ poise, $E=300$ volts/cm and $X=25$ $\mu$m yields a ripple subsidence time T of approximately 44 seconds. As mentioned in the Background of the Invention, reliance on the pressure exerted by the inherent surface tension of the coating to effect a substantial reduction in ripple size may take up to twenty hours. The present invention thus substantially reduces the time required to induce subsidence of coating surface irregularities.

FIG. 3 shows an illustrative representation of a preferred embodiment of the ripple reduction apparatus 100 of the present invention. The apparatus 100 includes a system controller 110, which is electrically coupled to a high voltage source 120 via a signal line 125. The controller 110 may be implemented with a digital computer, and the signal line 125 allows the controller to switch the polarity and magnitude of the voltage of the source 120. The source 120 is electrically coupled to an ammeter 130 through a supply line 135. The ammeter 130 gauges the current flowing from the supply line 135 to a supply line 140, and thereby measures the aggregate current consumption of an array of conductive needles 150. The array of needles 150 is typically two dimensional, although only a single dimension is depicted in FIG. 3. The needle array 150 is mechanically coupled to a robot arm 220 by conventional means (not shown). The needles 160 within the array 150 will typically be spaced 0.5 to 1 inch apart. Each conductive needle 160 taps the supply line 140 through an associated isolating resistor 165.

As discussed above, in the preferred embodiment, each needle 160 is fabricated from a conductive material such as tungsten and includes a sharpened needle point 170. The radii of curvature of the needle points 170 are chosen in conjunction with the value of the voltage provided by the source 120 such that the electric field existing in the vicinity of each point 170 is of sufficient magnitude to induce atmospheric ionization at a desirable current controlling the processing rate. As the polarity of the source 20 is switchable, either positive or negative ions may be generated through such an atmospheric discharge.

As was discussed with reference to FIG. 2, ions produced by the needle array 150 migrate along electric field lines (not shown) to a surface 180 of a coating composition 190. Again, the coating 190 is clear (contains no pigment), and covers a previously applied pigmented base coat (not shown).

As shown in FIG. 3 the coating 190 has not yet solidified following application to an automobile surface 200, and resides thereon in a viscous liquid state.

As the needle array 150 is moved over the surface 180 a feedback loop formed by the ammeter 130, the line 230, the controller 110, an electromechanical position control device 210 and the robot arm 220 coupled thereto keeps the needle array 150 at a relatively constant distance "d" from the surface 180. Although the source 120 furnishes a DC voltage to the needle array 150, current propagates through each of the needles 160 in the form of Trischel pulses. As the distance "d" decreases, both the frequency of these pulses and the current through the needle array 150 increases. Accordingly, the ammeter 130 (or a frequency meter) is utilized to send signals to the controller 110 via the signal line drawn by the needle array 150, and to functions of the distance "d". The controller 110 then signals the position control device 210 through a signal line 240 to adjust the position of the robot arm 220 (and hence needle array 150) until the appropriate current flow is sensed by the ammeter 130. Apparatus which may be utilized to implement the position control device 210, is well within the capabilities of one of ordinary skill in the art.

In certain applications, it may be desirable to subject the entire portion of the surface 180, directly below the needle array 150, to a substantially uniform field (i.e., all points the same electrostatic pressure). Such uniformity would be achieved by ensuring that, on average, ions are distributed evenly above the surface 180, irrespective of the instantaneous location of each of the needles 160. One method of effecting this result would be to rotate the needle array 150 about an axis parallel to the orientation of the needles 160. In this manner the spatial uniformity of both the ions produced by the apparatus 100 and of the electric field resulting therefrom would be enhanced.

The embodiment of FIG. 3 could be modified in one of at least two ways to allow the needle array 150 to rotate in the manner prescribed above. One possibility would be to mechanically alter the robot arm 220 to rotate, as well as vertically position, the needle array 150. Alternatively, a separate mechanical device may be interposed between the robot arm 220 and needle array 150 to induce the rotation thereof.

In addition to smoothing the surface 180, the apparatus 100 of the present invention may also be used to "texturize" the surface 180. Specifically, as the distance "d" is reduced ions generated by the needles 160 will not be able to diffuse with substantial uniformity before being absorbed by the surface 180. That is, ions will be absorbed by the surface 180 very soon after being generated. As a consequence, the electrostatic pressure exerted on those areas of the surface 180 directly below each of the needles 160 will become substantially stronger than the pressure applied elsewhere on the surface 180. For example, if the needle array 150 is fixed a sufficiently short distance over a particular region of the surface 180 a dimple pattern will emerge thereon mirroring the arrangement of the needles 160. Similarly, in the event the array 150 is horizontally translated in close proximity to the surface 180, a pattern of "troughs" will be etched thereon. In this manner the apparatus 100 may be utilized to impart a desired texture to the surface 180. Certain designs could of course be recorded on the surface most effectively by using a single conductive needle rather than the needle array 150.

Thus the present invention has been described with reference to a particular embodiment in connection with a particular application. Those having ordinary skill in the art and access to the teachings of the present invention will recognize additional modifications and applications within the scope thereof. For example, instruments other than an array of sharpened needles may be utilized to generate the electric field required to induce an atmospheric ionic discharge. Similarly, the invention is not limited to the particular electrical system disclosed herein for supplying an ionization voltage and controlling the position of the needle array. Those skilled in the art may be aware of other system configurations which would maintain a relatively constant distance between the needle array and coating surface. Additionally, charged particles other than ions may be appropriate for generating electrostatic pressure in alternative embodiments of the present invention.

It is therefore contemplated by the appended claims to cover any and all such modifications.

Accordingly,

What is claimed is:

1. A technique for expediting the subsidence of irregularities on a surface o a viscous coating composition applied to an electrically conductive object comprising the steps of:

(a) providing electrical conductor means having a curved end with a radius of curvature;

(b) positioning said curved end a desired distance above and facing said surface in a volume of space containing a gas;

(c) coupling a voltage to said conductor, said voltage having a magnitude selected in combination with said radius of curvature to ionize said gas such that electrostatic pressure is exerted on an area of said surface sufficient to displace vertical irregularities in said area; and (d) applying said voltage to said conductor for a period of time to cause substantially complete subsidence of all vertical irregularities in said area.

2. The technique of claim 1 further including the step of translating said conductor through said volume of space.

3. The method of claim 1 further comprising the step of:

(a) coupling resistor means in series between said voltage and said conductor to limit the current to said conductor.

4. The method of claim 1 wherein said electrostatic pressure is substantially equal to $10^4$ times the surface tension of the coating.

5. The method of claim 1 further comprising the step of:

(a) rotating said conductor about an axis perpendicular to the surface of the coating.

6. The method of claim 1 further comprising the step of:

(a) simultaneously performing steps (a)-(d) for a plurality of such conductor positioned in said volume of space above said surface to cause substantially complete subsidence of vertical irregularities over the entire surface of the coating.

7. The method of claim 1 wherein said conductor is a needle.

8. The technique of claim 1 wherein said coating is nonmetallic.

9. A technique for texturizing a surface of a viscous coating composition applied to an electrically conductive object comprising the steps of:

(a) providing an electrically conductive conductor having a curved end with a radius of curvature;

(b) positioning said curved end a desired distance above and facing said surface in a volume of space containing a gas;

(c) coupling a voltage to said conductor, said voltage having a magnitude selected in combination with said radius of curvature to ionize said gas such that electrostatic pressure is exerted on an area of said surface sufficient to eliminate substantially all vertical irregularities in said area; and (d) selectively translating said conductor within said volume of space such that said ionized gas causes areas of said coating surface to become substantially free of vertical irregularities, thereby forming a pattern of texturization of smooth and irregular areas over said surface.

10. The method of claim 5 further comprising the step of:

(a) coupling resistor means in series between said voltage and said needle to limit the current to said needle.

11. The method of claim 5 wherein said electrostatic pressure is substantially equal to $10^4$ times the surface tension of the coating.

12. The method of claim 5 further comprising the step of:

(a) rotating said conductor about and axis perpendicular to the surface of the coating.

13. The method of claim 9 further comprising the step of:

(a) simultaneously performing steps (a)–(d) for a plurality of such conductors positioned in said volume of space above said surface to cause substantially complete subsidence of vertical irregularities over the entire surface of the coating.

14. The method of claim 9 wherein said conductor is a needle.

15. The technique of claim 9 wherein said coating is nonmetallic.

16. A technique for affecting the texture of a surface of a nonmetallic coating applied to an electrically conductive object, comprising the steps of:

providing a gas filled volume above said surface;

ionizing said volume to generate electrostatic pressures on at least an area of said surface sufficient to displace vertical irregularities in said surface; and maintaining said ionization until substantially all vertical irregularities in said area have subsided.

17. The technique of claim 16 wherein said electrostatic pressure is substantially equal to $10^4$ times the surface tension of the coating.

* * * * *